US010156338B2

(12) United States Patent
Fukui et al.

(10) Patent No.: US 10,156,338 B2
(45) Date of Patent: Dec. 18, 2018

(54) POWER SUPPLY, LIGHTING DEVICE, HEADLIGHT DEVICE AND VEHICLE

(71) Applicant: Panasonic Intellectual Property Management Co., Ltd., Osaka (JP)

(72) Inventors: Takahiro Fukui, Osaka (JP); Masanobu Murakami, Osaka (JP); Takahiro Ohori, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/927,762

(22) Filed: Mar. 21, 2018

(65) Prior Publication Data

US 2018/0283643 A1 Oct. 4, 2018

(30) Foreign Application Priority Data

Mar. 28, 2017 (JP) ..... 2017-063151

(51) Int. Cl.

| | |
|---|---|
| ***F21S 45/10*** | (2018.01) |
| ***F21V 29/50*** | (2015.01) |
| ***H05B 37/02*** | (2006.01) |
| ***F21V 23/02*** | (2006.01) |
| ***F21S 45/43*** | (2018.01) |
| *F21S 41/141* | (2018.01) |
| *F21Y 115/10* | (2016.01) |

(52) U.S. Cl.

CPC ..... *F21S 45/10* (2018.01); *F21S 45/43* (2018.01); *F21V 23/02* (2013.01); *F21S 41/141* (2018.01); *F21Y 2115/10* (2016.08)

(58) Field of Classification Search

CPC .. F21S 45/10; F21S 45/40; F21S 45/43; F21S 41/141; F21V 29/50; F21V 29/503; F21V 29/61; H05B 37/02; H05B 41/2928; H05B 41/36

See application file for complete search history.

(56) References Cited

U.S. PATENT DOCUMENTS

| | | | | |
|---|---|---|---|---|
| 4,283,658 A * | 8/1981 | Parker | H05B 41/36 315/117 |
| 5,825,642 A * | 10/1998 | Ishii | H02M 3/28 363/141 |
| 6,353,295 B1 * | 3/2002 | Sridhar | H01L 23/467 257/E23.099 |
| 2013/0112367 A1 * | 5/2013 | Kooken | B23K 9/1006 165/11.1 |
| 2014/0241001 A1 * | 8/2014 | Yoshikawa | F21V 29/60 362/547 |

FOREIGN PATENT DOCUMENTS

| | | |
|---|---|---|
| JP | 2010-153343 A | 7/2010 |
| JP | 5479744 B2 | 2/2014 |

* cited by examiner

*Primary Examiner* — Thai Pham

(74) *Attorney, Agent, or Firm* — Renner Otto Boisselle & Sklar, LLP

(57) ABSTRACT

A lighting device includes an output adjustment circuit, a smoothing circuit and a control circuit. The smoothing circuit receives a binary rotation detection signal according to the rotation of a fan and smooths the rotation detection signal to produce a smoothed signal. The control circuit detects a rotation malfunction of the fan when the smoothed signal is greater than or equal to an upper limit threshold over first predetermined time or when the smoothed signal is smaller than or equal to a lower limit threshold over second predetermined time.

17 Claims, 11 Drawing Sheets

POWER SUPPLY, LIGHTING DEVICE, HEADLIGHT DEVICE AND VEHICLE

CROSS REFERENCE TO RELATED APPLICATION

This application claims the benefit and priority of Japanese Patent Application No. 2017-063151, filed on Mar. 28, 2017, the entire contents of which is incorporated herein by reference.

TECHNICAL FIELD

The present disclosure relates to a power supply, a lighting device, a headlight device and a vehicle.

BACKGROUND ART

In a related lighting device, it has been widespread to cause a light source such as (a) light emitting diodes (LEDs) to go on. In the field of lighting devices configured to cause vehicle headlights to go on, headlight devices equipped with LEDs and the like as light sources have been mass-produced.

A conventional headlight device may include a cooling fan for cooling a light source. Such a conventional headlight device drives the fan to increase thermal diffusion effect, thereby suppressing an increase in temperature caused by heating of the light source. The fan may however decrease a speed of rotation thereof or stop rotating due to aged deterioration of the fan, and the like. The fan decreasing the speed of rotation or stopping rotating may cause a malfunction of the headlight device as a result of an increase in temperature of the light source.

A headlight device disclosed in JP 2010-153343 A (hereinafter referred to as "Document 1") is configured to receive, from a fan, a pulse signal synchronized with a speed of rotation of the fan and detect a rotation malfunction of the fan when a high or low level duration (pulse width) during one cycle of the pulse signal is predetermined time or more. In the headlight device of Document 1, when a rotation malfunction of the fan is detected, a control circuit of the headlight device stops the supply of electric power to a light source and the fan.

In a lighting device like Document 1, a binary signal such as a pulse signal is employed as a rotation detection signal representing a speed of rotation of a fan.

In a related art such as Document 1, there is a possibility that a rotation malfunction will be detected in error owing to instantaneous fluctuation of a binary rotation detection signal.

SUMMARY OF INVENTION

It is an object of the present disclosure to provide a power supply, a lighting device, a headlight device and a vehicle, capable of detecting a rotation malfunction of a fan according to a rotation detection signal while suppressing the occurrence of a rotation malfunction of the fan detected in error.

A lighting device according to an aspect of the present disclosure includes a first power supply circuit, a second power supply circuit and an output adjustment circuit. The first power supply circuit is configured to cause provide first electric power to a lighting load, thereby causing the lighting load to be lit. The second power supply circuit is configured to provide a fan with second electric power in order to rotate the fan. The fan is configured to cool at least one of the first power supply circuit and the lighting load. The output adjustment circuit is configured to control the first power supply circuit and the second power supply circuit to adjust the first electric power and the second electric power. The output adjustment circuit includes a smoothing circuit and a control circuit. The smoothing circuit is configured to receive and smooth a rotation detection signal to produce a smoothed signal. The rotation detection signal is a binary signal in accordance with rotation of the fan. The control circuit is configured to: detect a rotation malfunction of the fan when the smoothed signal is larger than or equal to an upper limit threshold over first predetermined time or when the smoothed signal is smaller than or equal to a lower limit threshold smaller than the upper limit threshold over second predetermined time; and vary at least one of the first electric power and the second electric power when detecting (the occurrence of) the rotation malfunction.

A headlight device according to an aspect of the present disclosure includes the lighting device, the fan that is configured to output the rotation detection signal, and a headlight body to which the lighting device and the fan are attached.

A vehicle according to an aspect of the present disclosure includes the headlight device, and a vehicle body that is equipped with the headlight device.

BRIEF DESCRIPTION OF DRAWINGS

The figures depict one or more implementations in accordance with the present teaching, by way of example only, not by way of limitation. In the figures, like reference numerals refer to the same or similar elements where.

DESCRIPTION OF EMBODIMENTS

The following embodiments relate generally to power supplies, lighting devices, headlight devices and vehicles and, more particularly, to a lighting device configured to detect the occurrence of a rotation malfunction of a fan according to a binary rotation detection signal, a headlight device including the lighting device, and a vehicle including the lighting device.

The embodiments of the present disclosure will hereinafter be explained with reference to drawings.

Embodiment 1

Figure 1:
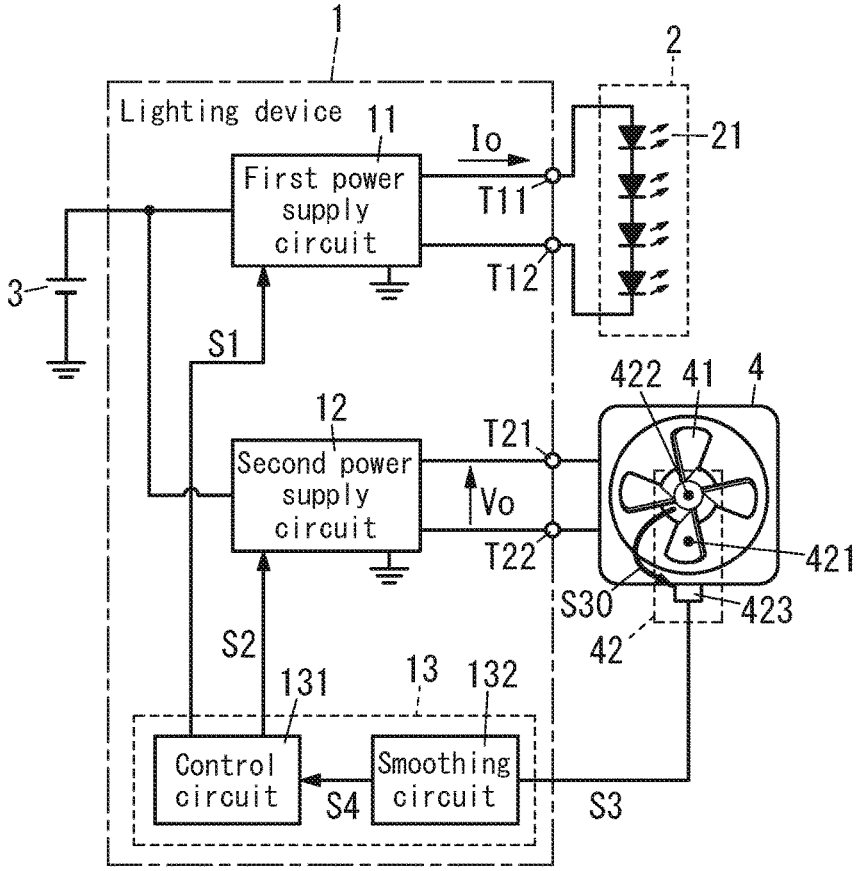
FIG. 1 is a block diagram showing a lighting device according to Embodiment 1.

FIG. 1 shows a block diagram of a lighting device 1 according to Embodiment 1.

The lighting device 1 includes a first power supply circuit 11, a second power supply circuit 12 and an output adjustment circuit 13.

The first power supply circuit 11 is configured to provide a lighting load 2 with first electric power. Preferably, the lighting load 2 includes LEDs 21 as a light source and is configured to be lit by the first electric power. Specifically, the first power supply circuit 11 may receive DC power from a DC power supply 3 such as a battery to provide the lighting load 2 with DC power as the first electric power. For example, the first power supply circuit 11 is composed of a current adjustment circuit, and will operate so as to cause a load current Io to the lighting load 2 to accord with a target current based on a first control signal S1 from the output adjustment circuit 13. Therefore, when the target current—a target current value is varied, the load current Io provided from the first power supply circuit 11 to the lighting load 2 is also varied. In this case, the adjustment of the load current Io corresponds to the adjustment of the first electric power.

The second power supply circuit 12 is configured to receive DC power from the DC power supply 3 to provide a fan 4 with DC power as second electric power. For example, the second power supply circuit 12 is composed of a voltage adjustment circuit, and will operate so as to cause drive voltage Vo to the fan 4 to accord with a target voltage. Therefore, when the target voltage—a target voltage value is varied, the drive voltage Vo provided from the second power supply circuit 12 to the fan 4 is also varied. In this case, the adjustment of the drive voltage Vo corresponds to the adjustment of the second electric power.

The output adjustment circuit 13 preferably includes a control circuit 131 and a smoothing circuit 132. The output adjustment circuit 13 is configured to control the operation of the first power supply circuit 11 to adjust (a value of) the load current Io, and also control the operation of the second power supply circuit 12 to adjust (a value of) the drive voltage Vo.

The control circuit 131 has, for example a computer. The computer includes, as main components, a device including a processor that executes a program, an interface device that allows the processor to transmit or receive signals to and from other devices, and a memory device that stores the program, data and the like. The device including the processor may be any of a central or micro processing unit (CPU or MPU) that is separate from the memory device, and a microcomputer integrally including the memory device. A storage device such as a semiconductor memory with a short access time is mainly employed as the memory device. Examples of the program provision include the provision through a non-transitory computer readable medium (storage medium) storing the program in advance such as a read only memory (ROM) and an optical disk, and the provision through a storage medium (non-transitory computer readable medium) to which the program is supplied through a wide area communication network including the Internet and the like. The computer executes the program, and thereby the control circuit 131 controls the first and second power supply circuits 11 and 12.

The control circuit 131 may be composed of an integrated circuit (IC) for lighting control, configured to perform the lighting control of a light source.

In a specific example of the operation, the control circuit 131 provides the first power supply circuit 11 with the first control signal S1 representing the target current value. The first power supply circuit 11 operates so as to cause the value of the load current Io to accord with the target current value represented by the first control signal S1. That is, the first power supply circuit 11 causes the value of the load current Io to accord with the target current value. The control circuit 131 varies the target current value to be notified to the first power supply circuit 11, thereby making it possible to adjust the value of the load current Io.

The control circuit 131 also provides the second power supply circuit 12 with a second control signal S2 representing the target voltage value. The second power supply circuit 12 operates so as to cause the value of the drive voltage Vo to accord with the target voltage value represented by the second control signal S2. That is, the second power supply circuit 12 causes the value of the drive voltage Vo to accord with the target voltage value. The control circuit 131 varies the target voltage value to be notified to the second power supply circuit 12, thereby making it possible to adjust the value of the drive voltage Vo.

The fan 4 is preferably configured to send air to the first power supply circuit 11 and the lighting load 2 to cool the first power supply circuit 11 and the lighting load 2. The fan 4 has rotating blades 41 that go round to create a current of air. In one example, when the drive voltage Vo is increased, the number of rotations per unit time (hereinafter simply also referred to as a "speed of rotation") of the fan 4 is increased, thereby increasing the quantity of heat to be dissipated away from each of the first power supply circuit 11 and the lighting load 2. Conversely, when the drive voltage Vo is decreased, the speed of rotation of the fan 4 is decreased, thereby decreasing the quantity of heat to be dissipated away from each of the first power supply circuit 11 and the lighting load 2. That is, the fan 4 is configured to increase and decrease the speed of rotation in proportion to the drive voltage Vo. Note that the fan 4 may cool only any one of the first power supply circuit 11 and the lighting load 2.

In the example, the fan 4 further includes a signal generator 42. The signal generator 42 preferably has a magnet 421, a magnetic field sensor 422 and an output circuit 423. The magnet 421 is configured to integrally rotate along with the blades 41. The magnetic field sensor 422 is configured to detect a change in magnetic field according to the rotation of the magnet 421. The output circuit 423 is configured to convert the change in the magnetic field (the varying magnetic field) detected through the magnetic field sensor 422 into an electric signal, thereby outputting a binary rotation detection signal S3 synchronized with the rotation of the fan 4. The rotation detection signal S3 is a pulse signal that alternately repeats high-level voltage and low-level voltage in synchronization with the rotation of the fan 4. As shown in "S3" of FIG. 3, when the speed of rotation of the fan 4 is increased, high and low level durations are shortened, thereby increasing a frequency of the rotation detection signal S3. Conversely, when the speed of rotation of the fan 4 is decreased, high and low level durations are lengthened, thereby decreasing the frequency of the rotation detection signal S3.

The smoothing circuit 132 is configured to receive and smooth the rotation detection signal S3 to output a smoothed signal S4. Preferably, the smoothed signal S4 is a DC voltage signal whose voltage varies according to a change in the speed of rotation of the fan 4.

The control circuit 131 is configured to receive the smoothed signal S4 to detect the occurrence of a rotation malfunction of the fan 4 based on the voltage of the smoothed signal S4. In other words, the control circuit 131 judges that a rotation malfunction of the fan 4 occurs, thereby detecting the occurrence of the rotation malfunction of the fan 4.

If detecting no occurrence of any rotation malfunction of the fan 4 when the lighting load 2 is lit, the control circuit 131 preferably notifies the first power supply circuit 11 of a first control signal S1 representing a target current value for ordinary lighting (e.g., rated current value) that is predetermined with respect to the lighting load 2. The target current value for ordinary lighting is hereinafter referred to as an "ordinary target current value". In addition, the control circuit 131 preferably notifies the second power supply circuit 12 of a second control signal S2 representing a target voltage value for ordinary operation (e.g., rated voltage value) that is predetermined with respect to the fan 4. The target voltage value for ordinary operation is hereinafter referred to as an "ordinary target voltage value". Thus, when no rotation malfunction of the fan 4 occurs, the lighting state of the lighting load 2 is adjusted to an ordinary lighting state, while the speed of rotation of the fan 4 is adjusted to a speed of rotation for ordinary operation.

On the other hand, if detecting the occurrence of a rotation malfunction of the fan 4 when the lighting load 2 is lit, the control circuit 131 preferably notifies the first power supply circuit 11 of a first control signal S1 representing a target current value for rotation malfunction that is predetermined with respect to the lighting load 2. The target current value for rotation malfunction is hereinafter referred to as a "temporary target current value". In addition, the control circuit 131 preferably notifies the second power supply circuit 12 of a second control signal S2 representing a target voltage value for rotation malfunction that is predetermined with respect to the fan 4. The target voltage value for rotation malfunction is hereinafter referred to as a "temporary target voltage value". Thus, when a rotation malfunction of the fan 4 occurs, the lighting state of the lighting load 2 is adjusted to a lighting state for rotation malfunction, while the speed of rotation of the fan 4 is adjusted to a speed of rotation for rotation malfunction.

The output adjustment circuit 13 (control circuit 131 and smoothing circuit 132) will hereinafter be explained in detail.

Figure 2:
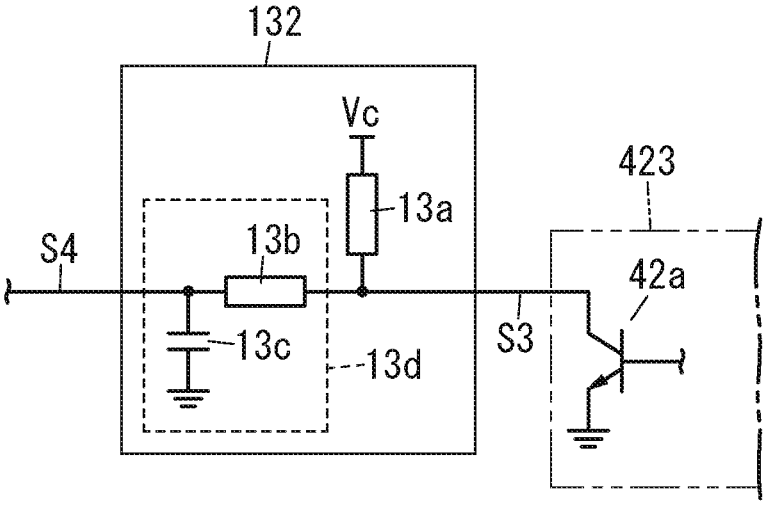
FIG. 2 is a circuit diagram showing the configuration of a smoothing circuit in the lighting device.

As shown in FIG. 2, the output circuit 423 of the fan 4 (signal generator 42) preferably has an open collector type output stage that includes an NPN type transistor 42*a*. In the example of FIG. 2, the transistor 42*a* has a collector that is electrically connected to an input end of the smoothing circuit 132, and an emitter that is electrically connected to control ground of the smoothing circuit 132.

As shown in FIG. 2, the smoothing circuit 132 preferably includes a pull-up resistor 13*a*, a smoothing resistor 13*b* and a smoothing capacitor 13*c*. The resistor 13*a* has a first end that is electrically connected to a control power supply (e.g., supply source of control voltage Vc to output adjustment circuit 13), and a second end. The resistor 13*b* has a first end that is electrically connected to the second end of the resistor 13*a*, and a second end. The capacitor 13*c* has a first end that is electrically connected to the second end of the resistor 13*b*, and a second end that is electrically connected to the control ground of the smoothing circuit 132. A junction of the resistors 13*a* and 13*b* forms the input end of the smoothing circuit 132 that is electrically connected to the collector of the transistor 42*a*.

The transistor 42*a* turns on and off in synchronization with the rotation of the fan 4, and then the rotation detection signal S3 synchronized with the rotation of the fan 4 occurs at the collector of the transistor 42*a*. In this case, the high-level voltage of the rotation detection signal S3 is equal to electric potential of the control voltage Vc, and the low-level voltage of the rotation detection signal S3 is equal to electric potential of the control ground of the smoothing circuit 132.

The resistor 13*b* and the capacitor 13*c* constitute a low pass filter 13*d*. The rotation detection signal S3 is smoothed with the low pass filter 13*d*. The smoothing circuit 132 outputs voltage across the capacitor 13*c* as the smoothed signal S4.

The control circuit 131 preferably has an upper limit threshold Vt1 and a lower limit threshold Vt2 that are set in advanced for comparison with the smoothed signal S4. Each of the upper and lower limit thresholds Vt1 and Vt2 has a positive value, and the upper limit threshold Vt1 is set to be a value larger than a value of the lower limit threshold Vt2. The control circuit 131 is therefore to compare the smoothed signal S4 with the upper and lower limit thresholds Vt1 and Vt2. The control circuit 131 judges that no rotation malfunction of the fan 4 occurs, when the smoothed signal S4 is smaller than the upper limit threshold Vt1 and larger than the lower limit threshold Vt2. In contrast, the control circuit 131 judges that a rotation malfunction of the fan 4 occurs, when the smoothed signal S4 is larger than or equal to the upper limit threshold Vt1 over first predetermined time T1, or when the smoothed signal S4 is smaller than or equal to the lower limit threshold Vt2 over second predetermined time T2.

Note that the first predetermined time T1 may have length of time identical to or different from that of the second predetermined time T2.

Here, preferably the resistor 13*b* and the capacitor 13*c* respectively have a resistance value and a capacitance value that are set based on the frequency of the rotation detection signal S3. That is, the low pass filter 13*d* preferably has a cut-off frequency that is set based on the frequency of the rotation detection signal S3. For example, when the rotation detection signal S3 has a frequency that is a first frequency higher than a second frequency, the resistor 13*b* and the capacitor 13*c* respectively have a resistance value and a capacitance value that are decreased as compared to the case where the rotation detection signal S3 has the second frequency. Conversely, when the rotation detection signal S3 has the second frequency, the resistor 13*b* and the capacitor 13*c* respectively have a resistance value and a capacitance value that are increased as compared to the case where the rotation detection signal S3 has the first frequency. In other words, the values of the resistor 13*b* and the capacitor 13*c* defining the cut-off frequency of the low pass filter 13*d* are determined based on a predetermined frequency range of the rotation detection signal S3. It is consequently possible to suppress unsuccessful detection of a rotation malfunction of the fan 4 and the occurrence of a rotation malfunction of the fan 4 detected in error.

Specifically, let the upper limit threshold Vt1 be 2.8 [V] and the high-level voltage of the rotation detection signal S3 be 5 [V]. In case no rotation malfunction of the fan 4 occurs, let the frequency of the rotation detection signal S3 be 10 [Hz] and on-duty of the rotation detection signal S3 be 50 [%].

In this case, when the resistance value of the resistor 13*b* and the capacitance value of the capacitor 13*c* are set to 10 [kΩ] and 10 [μF], respectively, the smoothed signal S4 fluctuates in the range of 1.85 to 3.15 [V] if no rotation malfunction of the fan 4 occurs. That is, the smoothed signal S4 becomes undulating voltage that fluctuates in the range of 1.85 to 3.15 [V]. The control circuit 131 may therefore detect a rotation malfunction of the fan 4 in error even when no rotation malfunction of the fan 4 occurs because there is a period of time when the smoothed signal S4 is larger than or equal to the upper limit threshold Vt1.

In contrast, when the resistance value of the resistor 13*b* and the capacitance value of the capacitor 13*c* are set to 10 [kΩ] and 100 [μF], respectively, the smoothed signal S4 fluctuates in the range of 2.32 to 2.45 [V] if no rotation malfunction of the fan 4 occurs. That is, the smoothed signal S4 becomes undulating voltage that fluctuates in the range of 2.32 to 2.45 [V]. The smoothed signal S4 becomes therefore smaller than the upper limit threshold Vt1 when no rotation malfunction of the fan 4 occurs, thereby preventing the control circuit 131 from detecting a rotation malfunction of the fan 4 to suppress the occurrence of a rotation malfunction of the fan 4 detected in error.

It is also possible to suppress, with respect to the lower limit threshold Vt2, unsuccessful detection of the occurrence of a rotation malfunction of the fan 4 and the occurrence of a rotation malfunction of the fan 4 detected in error, by setting the resistance value of the resistor 13*b* and the capacitance value of the capacitor 13*c* based on the frequency of the rotation detection signal S3.

As stated above, unsuccessful detection of the occurrence of a rotation malfunction of the fan 4 and the occurrence of a rotation malfunction of the fan 4 detected in error with respect to the upper and lower limit thresholds Vt1 and Vt2 can be suppressed by setting the resistance value of the resistor 13*b* and the capacitance value of the capacitor 13*c* based on the frequency of the rotation detection signal S3.

In order to increase respective sensitivities to the upper and lower limit thresholds Vt1 and Vt2, the resistance value of the resistor 13*b* and the capacitance value of the capacitor 13*c* need to be decreased. In order to decreasing respective sensitivities to the upper and lower limit thresholds Vt1 and Vt2, the resistance value of the resistor 13*b* and the capacitance value of the capacitor 13*c* need to be increased.

Specifically, let the upper limit threshold Vt1 be 2.8 [V] and the high-level of the rotation detection signal S3 be 5 [V]. In case no rotation malfunction of the fan 4 occurs, let the frequency of the rotation detection signal S3 be 1 [kHz] and the on-duty of the rotation detection signal S3 be 50 [%].

In this case, when the resistance value of the resistor 13*b* and the capacitance value of the capacitor 13*c* are set to 1 [kΩ] and 10 [μF], respectively, the smoothed signal S4 fluctuates in the range of 2.44 to 2.56 [V] if no rotation malfunction of the fan 4 occurs. That is, the smoothed signal S4 becomes undulating voltage that fluctuates in the range of 2.44 to 2.56 [V]. There is however a possibility that a rotation malfunction of the fan 4 will be detected in error, when the frequency of the rotation detection signal S3 becomes lower than 200 [Hz] because the smoothed signal S4 becomes larger than or equal to 2.8 [V] as the upper limit threshold Vt1.

When the resistance value of the resistor 13*b* and the capacitance value of the capacitor 13*c* are set to 0.5 [kΩ] and 10 [μF], respectively, the smoothed signal S4 fluctuates in the range of 2.37 to 2.63 [V] if no rotation malfunction of the fan 4 occurs. That is, the smoothed signal S4 becomes undulating voltage that fluctuates in the range of 2.37 to 2.63 [V]. There is however a possibility that a rotation malfunction of the fan 4 will be detected in error, when the frequency of the rotation detection signal S3 becomes lower than 400 [Hz] because the smoothed signal S4 becomes larger than or equal to 2.8 [V] as the upper limit threshold Vt1.

The resistance value of the resistor 13*b* and the capacitance value of the capacitor 13*c* can also be set in advance so that the sensitivity to the lower limit threshold Vt2 becomes an intended sensitivity.

Each of the respective sensitivities to the upper and lower limit thresholds Vt1 and Vt2 can be set to an intended sensitivity by setting the resistance value of the resistor 13*b* and the capacitance value of the capacitor 13*c* in advance as stated above. For example, when a resistance value of the resistor 13*b* and a capacitance value of the capacitor 13*c* are set so that the smooth signal S4 tends to rise to the upper limit threshold value Vt1 or more, the sensitivity to the upper limit threshold value Vt1 increases. In addition, when the resistance value of the resistor 13*b* and the capacitance value of the capacitor 13*c* are set so that the smooth signal S4 tends to decrease to the lower limit threshold Vt2, the sensitivity to the lower limit threshold value Vt2 increases.

Preferably, the resistance value of the resistor 13*b* and the capacitance value of the capacitor 13*c* are further set based on each value of the upper and lower limit thresholds Vt1 and Vt2 in addition to the frequency of the rotation detection signal S3.

An operation of the present embodiment when a rotation malfunction of the fan 4 occurs will hereinafter be explained with reference to FIG. 3.

The rotation detection signal S3 is a binary pulse signal synchronized with the rotation of the fan 4. The rotation detection signal S3 has an increased frequency when the speed of rotation of the fan 4 is increased, while the rotation detection signal S3 has a decreased frequency when the speed of rotation of the fan 4 is decreased. The smoothed signal S4 has voltage that varies according to the speed of rotation of the fan 4, namely the frequency of the rotation detection signal S3. Herein, the resistance value of the resistor 13*b* and the capacitance value of the capacitor 13*c* are set so that the smoothed signal S4 has voltage that is decreased or increased when the frequency of the rotation detection signal S3 is increased or decreased, respectively.

Figure 3:
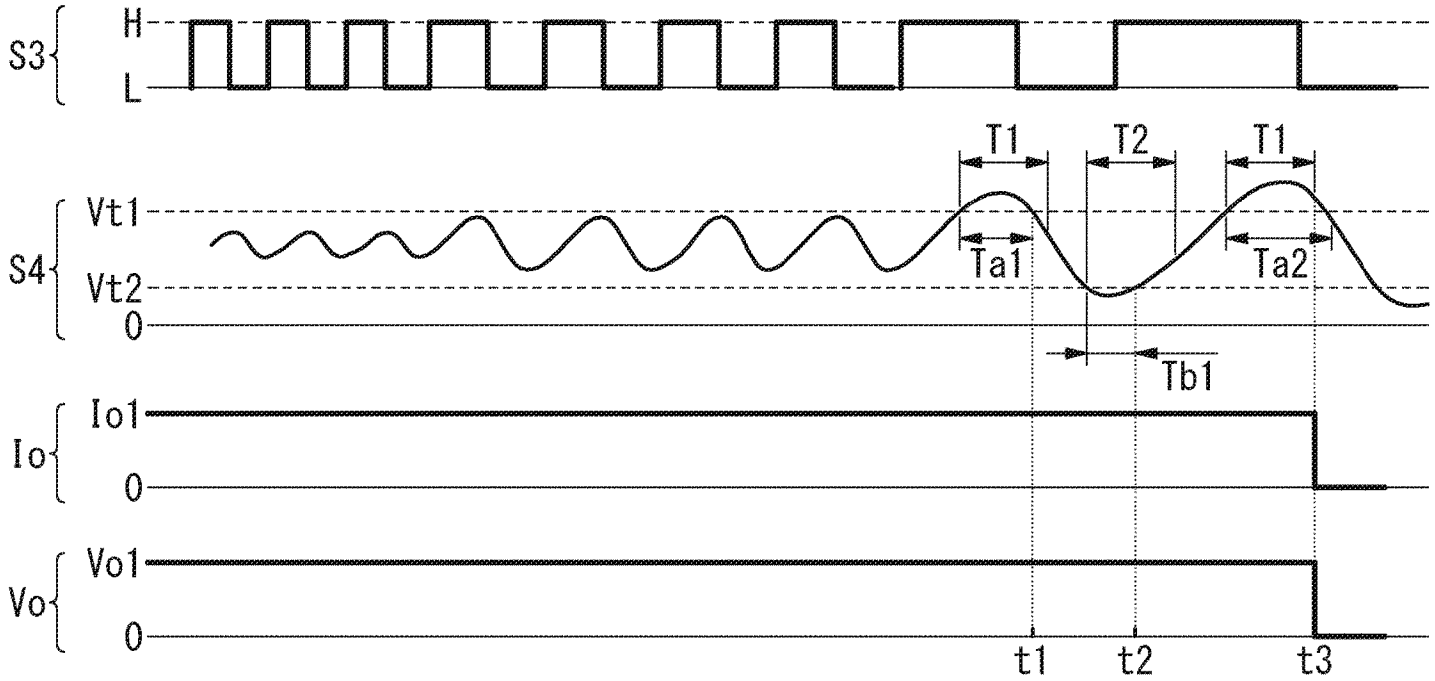
FIG. 3 depicts, from top to bottom, respective waveforms of a rotation detection signal, a smoothed signal, a load current and drive voltage in the lighting device.

In "S3" of FIG. 3, the speed of rotation of the fan 4 gradually decreases from the speed of rotation at an ordinary state thereof caused by aging of the fan 4 or failure of the fan 4, so that the frequency of the rotation detection signal S3 gradually decreases.

The control circuit 131 preferably measures duration Ta during which the voltage of the smoothed signal S4 is larger than or equal to the upper limit threshold Vt1 as a result of a decrease in the speed of rotation of the fan 4. The control circuit 131 measures the duration Ta with a CR integration circuit that is configured to charge a capacitor via a resistor, while the voltage of the smoothed signal S4 is larger than or equal to the upper limit threshold Vt1. The control circuit 131 also measures duration Tb during which the voltage of the smoothed signal S4 is smaller than or equal to the lower limit threshold Vt2 as a result of a decrease in the speed of rotation of the fan 4. The control circuit 131 measures the duration Tb with a CR integration circuit that is configured to charge a capacitor vis a resistor, while the voltage of the smoothed signal S4 is smaller than or equal to the lower limit threshold Vt2. When the duration Ta is larger than or equal to first predetermined time T1, the control circuit 131 judges that a rotation malfunction of the fan 4 occurs. When the duration Tb is larger than or equal to second predetermined time T2, the control circuit 131 also judges that a rotation malfunction of the fan 4 occurs. Note that in the explanation below, each duration Ta is depicted as duration Tan (n: positive integer) when each duration Ta is distinguished from each other, while each duration Tb is depicted as duration Tbm (m: positive integer) when each duration Tb is distinguished from each other.

In "S4" of FIG. 3, the undulating voltage of the smoothed signal S4 gradually increases. The control circuit 131 sequentially measures duration Ta1, duration Tb1 and duration Ta2. The duration Ta1 and the duration Tb1 are shorter than the first predetermined time T1 and the second predetermined time t2, respectively, and then the control circuit 131 judges that no rotation malfunction of the fan 4 occurs (at timing t1 and timing t2). The duration Ta2 is larger than or equal to the first predetermined time T1, and then the control circuit 131 judges that a rotation malfunction of the fan 4 occurs (at timing t3).

Preferably, when detecting no occurrence of any rotation malfunction of the fan 4, the control circuit 131 notifies the first power supply circuit 11 of a first control signal S1 representing Io1 as the ordinary target current value. As shown in "Io" of FIG. 3, by adjusting a value of the load current Io to the ordinary target current value Io1, the first power supply circuit 11 causes the lighting load 2 to go on at an ordinary light output corresponding to the ordinary target current value Io1 (e.g., a rated light output).

Preferably, when detecting no occurrence of any rotation malfunction of the fan 4, the control circuit 131 also notifies the second power supply circuit 12 of a second control signal S2 representing Vo1 as the ordinary target voltage value. As shown in "Vo" of FIG. 3, by adjusting a value of the drive voltage Vo to the ordinary target voltage value Vo1, the second power supply circuit 12 causes the fan 4 to rotate at an ordinary speed of rotation corresponding to the ordinary target voltage value Vo1 (e.g., rated speed of rotation).

When detecting the occurrence of a rotation malfunction of the fan 4, the control circuit 131 preferably notifies the first power supply circuit 11 of a first control signal S1 representing 0 (zero) as the temporary target current value. As shown in "Io" of FIG. 3, the first power supply circuit 11 stops outputting the first electric power by adjusting the value of the load current Io to the temporary target current value 0.

In addition, when detecting the occurrence of the rotation malfunction of the fan 4, the control circuit 131 preferably notifies the second power supply circuit 12 of a second control signal S2 representing 0 (zero) as the temporary target voltage value. As shown in "Vo" of FIG. 3, the second power supply circuit 12 stops outputting the second electric power by adjusting the value of the drive voltage Vo to the temporary target voltage value 0.

Thus, when the rotation malfunction of the fan 4 occurs, the first and second power supply circuits 11 and 12 stop outputting their respective electric power, thereby extinguishing the lighting load 2 while stopping the fan 4. The control circuit 131 stops the fan 4, thereby making it possible to delay the progress of degradation or malfunction of the fan 4. The control circuit 131 also causes the first and second power supply circuits 11 and 12 to stop outputting their respective electric power, thereby decreasing quantity of heat generated from each of the power supply circuits. The control circuit 131 also causes the lighting load 2 to go out, thereby decreasing quantity of heat generated from the lighting load 2.

When a rotation malfunction of the fan 4 occurs, the first and second power supply circuits 11 and 12 may more decrease their respective electric power than the first and second electric power as ordinary electric power, thereby causing the lighting load 2 to go on at a dim light output (temporary light output) lower than the ordinary light output while causing the fan 4 to operate at a temporary speed of rotation less than the ordinary speed of rotation.

As stated above, the lighting device 1 includes the smoothing circuit 132 and can judge whether or not a rotation malfunction of the fan 4 occurs, based on the voltage of the smoothed signal S4.

For example, when the control circuit 131 is composed of an MPU, the MPU needn't include a timer function based on a clock signal in order to measure a pulse width of the rotation detection signal S3. The MPU needs to include an A/D converter function configured to convert a voltage value of the smoothed signal S4 into a digital value, and CR integrating circuits configured to measure the duration Ta and the duration Tb. By causing a comparator connected to an analog port in the MPU or the like to compare the voltage of the smoothed signal S4 with the upper and lower limit thresholds Vt1 and Vt2, the control circuit 131 can be composed of an inexpensive MPU, thereby having much choice of MPUs.

When the control circuit 131 is composed of a lighting control IC, not a lighting control IC for special purpose configured to detect a pulse width of the rotation detection signal S3 but a lighting control IC for general purpose may be employed as the control circuit 131. In this case, the lighting control IC for general purpose can detect the occurrence of a rotation malfunction of the fan 4 by receiving the rotation detection signal S3 at an analog port thereof. As a result, the choice of the lighting control ICs is spread and therefore various lighting devices can be designed.

Preferably, the control circuit 131 detect the occurrence of a rotation malfunction of the fan 4 when the smoothed signal S4 is larger than or equal to the upper limit threshold Vt1 over the first predetermined time T1 or when the smoothed signal S4 is smaller than or equal to the lower limit threshold Vt2 over the second predetermined time T2. It is therefore possible to prevent the control circuit 131 from detecting a rotation malfunction of the fan 4 in error due to instantaneous fluctuation in the rotation detection signal S3 and the smoothed signal S4.

In the related art of Document 1, no smoothing circuit is provided. The control circuit therefore needs to include a function for measuring a pulse width in order to detect the occurrence of a rotation malfunction based on a pulse signal synchronized with the speed of rotation of the fan. For example, when the control circuit is composed of an MPU, the MPU needs to include a timer function for measuring a pulse width thereof. No inexpensive MPUs include any timer function for measuring a pulse width in general. In order to measure a pulse width synchronized with the speed of rotation of the fan with the timer function, the lighting device needs to include a relatively expensive MPU because it needs to have a clock speed sufficiently faster than a speed of rotation of the fan.

In the related art of Document 1, when the control circuit is composed of a lighting control IC configured to perform the lighting control of the light source, the lighting control IC needs to have a pulse measuring function. There are however few lighting control ICs having a pulse measuring function, thereby making it difficult to design various lighting devices.

In the present embodiment, the smoothing circuit 132 is configured according to an signal aspect (e.g., frequency, voltage, pulse width or the like) of the rotation detection signal S3, thereby making it possible to correspond to various signal aspect of the rotation detection signals S3.

The control circuit 131 may increase a counter (first counter) by one increment every time the duration Ta is larger than or equal to the first predetermined time T1 and then judge that a rotation malfunction of the fan 4 occurs, when a value of the counter reaches a predetermined value that is two or more. The control circuit 131 may also increase a second counter by one increment every time the duration Tb is larger than or equal to the second predetermined time T2 and then judge that a rotation malfunction of the fan 4 occurs, when a value of the second counter reaches a predetermined value that is two or more. That is, the control circuit 131 may detect the occurrence of a rotation malfunction of the fan 4 when the number of times an (first) event of the duration Ta being larger than or equal to the first predetermined time T1 occurs reaches a (first) threshold more than one. In addition, the control circuit 131 may detect the occurrence of a rotation malfunction of the fan 4 when the number of times an (second) event of the duration Tb being larger than or equal to the second predetermined time T2 occurs reaches a (second) threshold more than one.

The control circuit 131 may also judge that no rotation malfunction of the fan 4 occurs, when the number of times the first event occurs is smaller than the first threshold, or when the number of times the second event occurs is smaller than the second threshold. The preferable example enables the control circuit 131 to suppress the occurrence of a rotation malfunction of the fan 4 detected in error.

Figure 4:
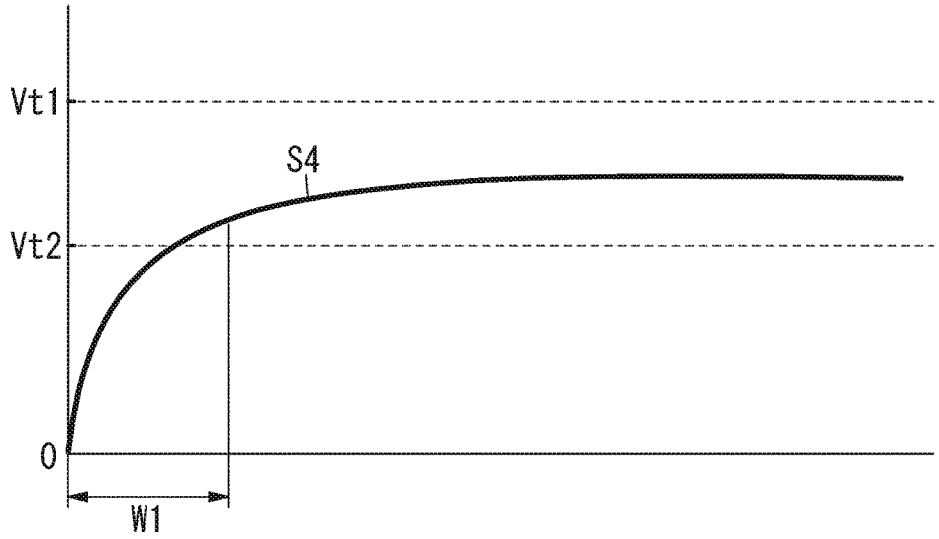
FIG. 4 depicts a waveform of the smoothed signal when the lighting device is activated.

The fan 4 is supplied with the second electric power from the second power supply circuit 12 when it is activated and then starts going round. When it is activated, the voltage of the smoothed signal S4 from the smoothing circuit 132 gradually increases according to a time constant of the low pass filter 13*d* including the resistor 13*b* and the capacitor 13*c* as shown in FIG. 4. The smoothed signal S4 when the fan 4 is activated therefore has transient time during which the voltage of the smoothed signal S4 rises according to the time constant of the low pass filter 13*d*. For example, the smoothed signal S4 takes about three seconds to reach 95 percent of a maximum value when the resistance value of the resistor 13*b* and the capacitance value of the capacitor 13*c* are set to 10 [kΩ] and 100 [μF], respectively. There is a high possibility that the control circuit 131 will detect the occurrence of a rotation malfunction of the fan 4 in error during the transient time. Therefore, the control circuit 131 is preferably prohibited from stopping the supply of the first electric power and the second electric power according to the occurrence of a rotation malfunction of the fan 4 for detection waiting time W1. Here, the detection waiting time W1 is a period of time from the time when the fan 4 is activated to the time when predetermined time elapses therefrom. The detection waiting time W1 is set to be longer than the length of time from the time when the fan 4 is activated to the time when the smoothed signal S4 reaches the lower limit threshold Vt2.

Specifically, the control circuit 131 starts measuring the detection waiting time W1 when the fan 4 is activated. Subsequently, during the detection waiting time W1, the control circuit 131 is prohibited from detecting the occurrence of a rotation malfunction of the fan 4, or prohibited from changing the target current value and the target voltage value from the ordinary target current value and the ordinary target voltage value even when detecting the occurrence of a rotation malfunction of the fan 4.

The speed of rotation of the fan 4 gradually increases after it is activated. The control circuit 131 may therefore employ the detection waiting time W1 as a waiting time for preventing a low speed of rotation of the fan 4 after it is activated from being detected as the occurrence of a rotation malfunction in error.

The control circuit 131 can therefore suppress the occurrence of a rotation malfunction of the fan 4 detected in error during the transient time after the fan 4 is activated.

Preferably, the first predetermined time T1 and the second predetermined time T2 are respectively set according to the upper threshold Vt1 and the lower limit threshold Vt2 in addition to the time constant of the low pass filter 13*d*. That is, the first predetermined time T1 and the second predetermined time T2 for suppressing the occurrence of a rotation malfunction of the fan 4 detected in error are set based on the values of the upper and lower limit thresholds Vt1 and Vt2 in addition to the waveform of the smoothed signal S4.

Embodiment 2

Figure 5:
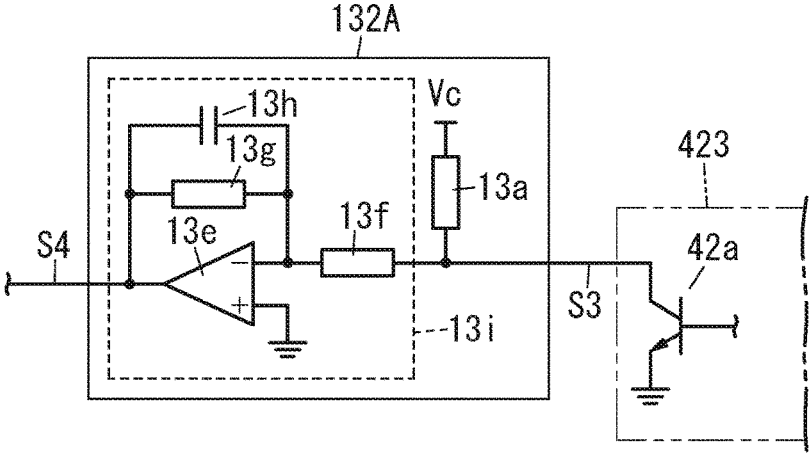
FIG. 5 is a circuit diagram showing the configuration of a smoothing circuit in a lighting device according to Embodiment 2.

A lighting device 1 according to Embodiment 2 will hereinafter be explained. As shown in FIG. 5, the lighting device 1 according to Embodiment 2 includes a smoothing circuit 132A instead of the smoothing circuit 132 in Embodiment 1. Like other components in Embodiment 2 are assigned the same reference numerals as depicted in Embodiment 1.

The smoothing circuit 132A includes a pull-up resistor 13*a*, an op-amp operational amplifier) 13*e*, resistors 13*f* and 13*g*, and a capacitor 13*h*. The resistor 13*a* has a first end that is electrically connected to a control power supply (e.g., supply source of control voltage Vc to output adjustment circuit 13), and a second end. The resistor 13*f* has a first end that is electrically connected to the second end of the resistor 13*a*, and a second end. The op-amp 13*e* has an inverted input terminal that is electrically connected to the second end of the resistor 13*f*, a non-inverted input terminal and an output terminal. The resistor 13*g* and the capacitor 13*h* constitute a parallel circuit that is electrically connected between the inverted input terminal and the output terminal of the op-amp 13*e*. The non-inverted input terminal of the op-amp 13*e* is electrically connected to the control ground of the smoothing circuit 132A.

The op-amp 13*e*, the resistors 13*f* and 13*g*, and the capacitor 13*h* constitute a low pass filter 13*i* that is configured to smooth a rotation detection signal S3. The smoothing circuit 132A is configured to output voltage of the output terminal of the op-amp 13*e* as a smoothed signal S4. In the low pass filter 13*i*, the op-amp 13*e* is employed as an inverting amplifier, and therefore the smoothed signal S4 has a value of 0 or less.

Here, preferably the resistor 13*g* and the capacitor 13*h* respectively have a resistance value and a capacitance value that are set according to a frequency of the rotation detection signal S3. That is, the low pass filter 13*i* preferably has a cut-off frequency that is set according to the frequency of the rotation detection signal S3. For example, when the rotation detection signal S3 has a frequency that is a first frequency higher than a second frequency, the resistor 13*g* and the capacitor 13*h* respectively have a resistance value and a capacitance value that are set to small values as compared to the case where the rotation detection signal S3 has the second frequency. Conversely, when the rotation detection signal S3 has the second frequency, the resistor 13*g* and the capacitor 13*h* respectively have a resistance value and a capacitance value that are set to large values as compared to the case where the rotation detection signal S3 has the first frequency. It is consequently possible to suppress unsuccessful detection of the occurrence of a rotation malfunction of the fan 4 and the occurrence of a rotation malfunction of the fan 4 detected in error.

Preferably, when respective sensitivity to the upper and lower limit thresholds is increased, the resistance value of the resistor 13*g* and the capacitance value of the capacitor 13*h* are decreased. Preferably, when the respective sensitivity to the upper and lower limit thresholds is decreased, the resistance value of the resistor 13*g* and the capacitance value of the capacitor 13*h* are increased.

The low pass filter 13*i* has an amplification function with a gain determined by [resistance value of resistor 13*g*/resistance value of resistor 13*f*]. Therefore, adequately setting the gain of the low pass filter 13*i* enables adjusting voltage of the smoothed signal S4 to a desired voltage.

In the low pass filter 13*i* of FIG. 5, the op-amp 13*e* is employed as the inverting amplifier, but may be employed as a non-inverting amplifier.

An operation when a rotation malfunction occurs in the fun 4 will explained with reference to FIG. 6.

Figure 6:
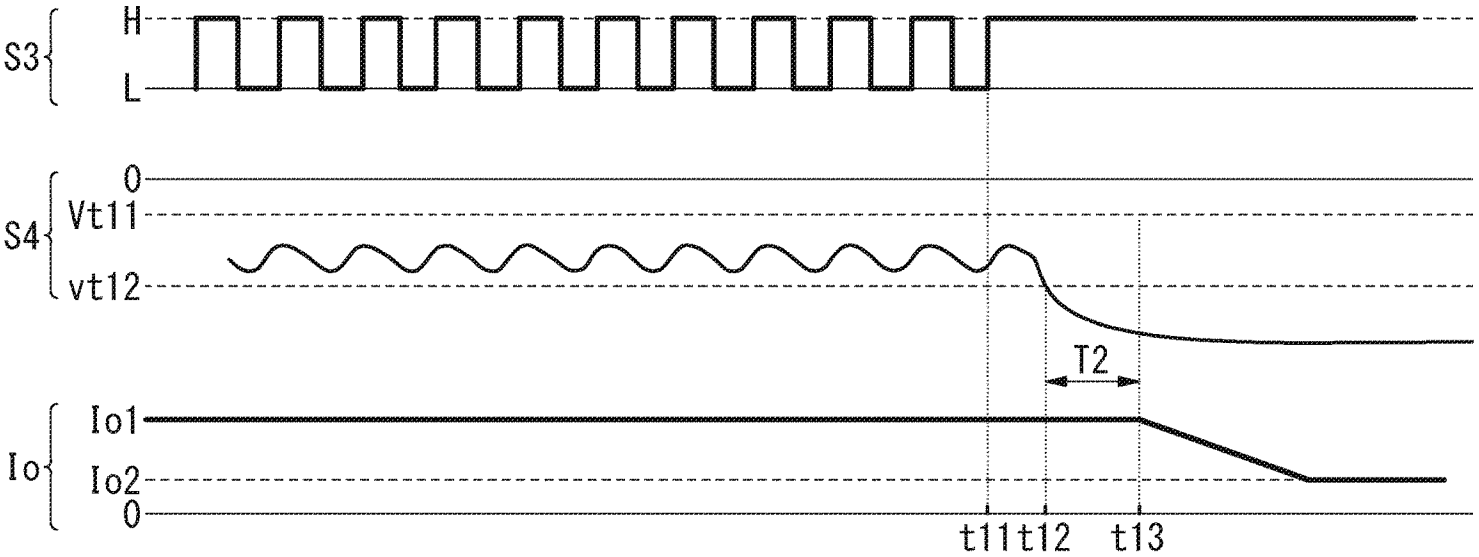
FIG. 6 depicts, from top to bottom, respective waveforms of a rotation detection signal, a smoothed signal and a load current in the lighting device.

As shown in "S3" of FIG. 6, a control circuit 131 preferably has an upper limit threshold Vt11 and a lower limit threshold Vt12 that are set in advance for comparison with the smoothed signal S4. Each of the upper and lower limit thresholds Vt11 and Vt12 has a negative value, and the upper limit threshold Vt11 is set to a value larger than that of the lower limit threshold Vt12—an absolute value of the upper limit threshold Vt11 is smaller than an absolute value of the lower limit threshold Vt12. The control circuit 131 compares the smoothed signal S4 with the upper and lower limit thresholds Vt11 and Vt12. The control circuit 131 judges that no rotation malfunction of the fan 4 occurs when the smoothed signal S4 is smaller than the upper limit threshold Vt11 and larger than the lower limit threshold Vt12. The control circuit 131 also judges that a rotation malfunction of the fan 4 occurs when the smoothed signal S4 is larger than or equal to the upper limit threshold Vt11 over first predetermined time T1, or when the smoothed signal S4 is smaller than or equal to the lower limit threshold Vt12 over second predetermined time T2.

In Embodiment 2, when the fan 4 is normally working, the rotation detection signal S3 is a pulse signal having frequency, duty and voltage that are predetermined as shown in "S3" of FIG. 6. In this case, the smoothed signal S4 is in the range smaller than the upper limit threshold Vt11 and larger than the lower limit threshold Vt12 as shown in "S4" of FIG. 6. The control circuit 131 therefore detects no occurrence of any rotation malfunction of the fan 4.

When detecting no occurrence of any rotation malfunction of the fan 4, the control circuit 131 preferably notifies a first power supply circuit 11 of a first control signal representing Io1 as an ordinary target current value. As shown in "Io" of FIG. 6, the first power supply circuit 11 adjusts a value of a load current Io to the ordinary target current value Io1, thereby causing a lighting load 2 to go on at an ordinary light output.

When a rotation malfunction of the fan 4 occurs (at timing t11), the rotation detection signal S3 becomes a constant high-level. As a result, the smoothed signal S4 decreases—an absolute value of the smoothed signal S4 increases. After the voltage of the smoothed signal S4 is smaller than or equal to the lower limit threshold Vt12 (at timing t12), the control circuit 131 detects the occurrence of a rotation malfunction of the fan 4 when the second predetermined time T2 elapses (at timing t13).

When detecting the occurrence of a rotation malfunction of the fan 4, the control circuit 131 preferably notifies the first power supply circuit 11 of a first control signal S1 representing Io2 as a temporary target current value. The temporary target current value Io2 is smaller than the ordinary target current value Io1, and therefore first electric power corresponding to the temporary target current value Io2 is smaller than first electric power corresponding to the ordinary target current value Io1. Accordingly, the first power supply circuit 11 adjusts the value of the load current Io to the temporary target current value Io2, thereby decreasing the first electric power.

Therefore, when a rotation malfunction of the fan 4 occurs, output power of the first power supply circuit 11 decreases and the lighting load 2 is lit at dim light output—it is dimmed. The control circuit 131 decreases the output power of the first power supply circuit 11, thereby decreasing quantity of heat from the first power supply circuit 11. The control circuit 131 also causes the lighting load 2 to go on at dim light output, thereby decreasing quantity of heat from the lighting load 2.

With Embodiment 2, when a rotation malfunction of the fan 4 occurs, the lighting load 2 is dimmed, and therefore the lighting load 2 continues emitting light even when the rotation malfunction of the fan 4 occurs. Accordingly, user's convenience is secured.

In Embodiment 2, the control circuit 131 preferably notifies a second power supply circuit 12 of a second control signal S2 representing Vo1 as an ordinary target voltage value both when detecting the occurrence of a rotation malfunction of the fan 4 and when detecting no occurrence of any rotation malfunction thereof.

Note that even in Embodiment 2, when a rotation malfunction of the fan 4 occurs, the first power supply circuit 11 may stop outputting electric power to extinguish the lighting load 2.

Even in Embodiment 2, when a rotation malfunction of the fan 4 occurs, the second power supply circuit 12 may stop outputting electric power or more decrease an output voltage value than an ordinary voltage value, thereby stopping the fan 4 or more decreasing the speed of rotation of the fan 4 than an ordinary speed of rotation.

Embodiment 3

Figure 7:
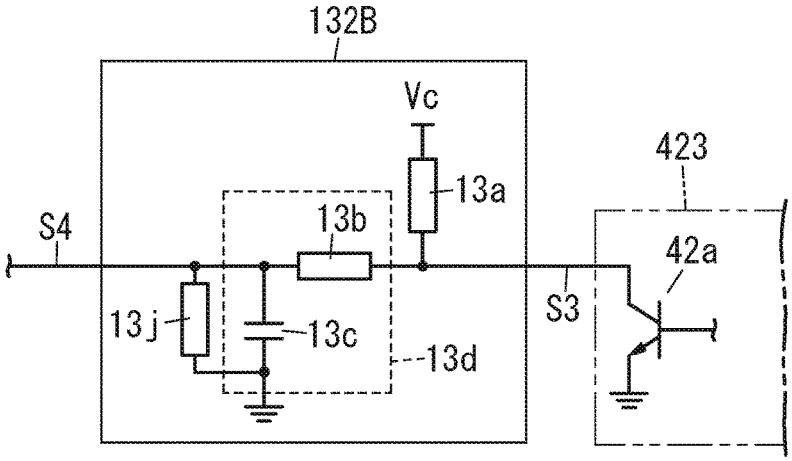
FIG. 7 is a circuit diagram showing the configuration of a smoothing circuit in a lighting device according to Embodiment 3.

A lighting device 1 according to Embodiment 3 will hereinafter be explained. The lighting device 1 according to Embodiment 3 includes a smoothing circuit 132B as shown in FIG. 7 instead of the smoothing circuit 132 in Embodiment 1. Like other components in Embodiment 3 are assigned the same reference numerals as depicted in Embodiment 1.

Figure 8:
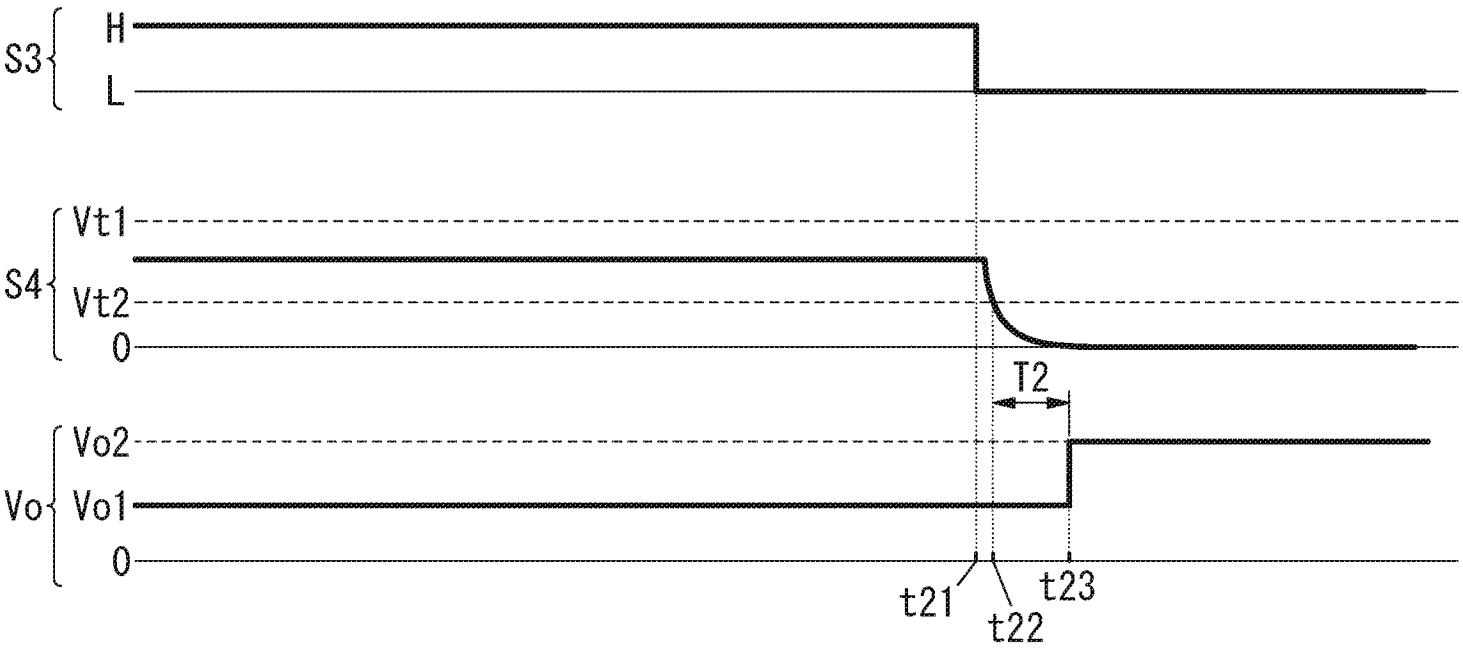
FIG. 8 depicts, from top to bottom, respective waveforms of a rotation detection signal, a smoothed signal and drive voltage in the lighting device.

In Embodiment 3, as shown in "S3" of FIG. 8, when a fan 4 is normal, a rotation detection signal S3 becomes a constant high-level. In this case, in order that a control circuit 131 judges that no rotation malfunction of the fan 4 occurs, a smoothed signal S4 needs to be in the range smaller than an upper limit threshold Vt1 and larger than a lower limit threshold Vt2 as shown in "S4" of FIG. 8.

Therefore, the smoothing circuit 132B includes a resistor 13*j* in addition to a pull-up resistor 13*a*, a smoothing resistor 13*b* and a smoothing capacitor 13*c*. The resistor 13*j* is electrically connected in parallel with the capacitor 13*c*.

When the rotation detection signal S3 is a high-level, control voltage Vc is divided by the resistors 13*a*, 13*b* and 13*j*, and voltage of the smoothed signal S4 is equal to voltage across the resistor 13*j*. In the lighting device 1 according to Embodiment 3, the resistors 13*a*, 13*b* and 13*j* has a division ratio that is set so that when the fan 4 is normal and the rotation detection signal S3 is a high-level, the voltage across the resistor 13*j* is in the range smaller than the upper limit threshold Vt1 and larger than the lower limit threshold Vt2.

The configuration is available to a case where the control circuit 131 is composed of a lighting control IC in which each of the upper and lower limit thresholds Vt1 and Vt2 is a fixed value. The resistors 13*a*, 13*b* and 13*j* may also have a division ratio that is set so that the voltage across the resistor 13*j* is biased towards one of the upper and lower limit thresholds Vt1 and Vt2 when the fan 4 is normal. In this case, sensitivity to one of the upper and lower limit thresholds Vt1 and Vt2 is high, while the other is low.

An operation when a rotation malfunction occurs in the fan 4 will be explained with reference to FIG. 8.

As shown in "S4" of FIG. 8, the control circuit 131 preferably has the upper and lower limit thresholds Vt1 and Vt2 that are set for comparison with the smoothed signal S4 in advance. The control circuit 131 compares the smoothed signal S4 with the upper and lower limit thresholds Vt1 and Vt2. The control circuit 131 judges that no rotation malfunction of the fan 4 occurs when the smoothed signal S4 is smaller than the upper limit threshold Vt1 and larger than the lower limit threshold Vt2. The control circuit 131 also judges that a rotation malfunction of the fan 4 occurs when the smoothed signal S4 is larger than or equal to the lower limit threshold Vt1 over first predetermined time T1 or when the smoothed signal S4 is smaller than or equal to the lower limit threshold Vt2 over second predetermined time T2.

In Embodiment 3, as shown in "S3" of FIG. 8, the rotation detection signal is a constant high-level when the fan 4 is normal. In this case, as shown in "S4" of FIG. 8, the smoothed signal S4 is in the range smaller than the upper limit threshold Vt1 and larger than the lower limit threshold Vt2. The control circuit 131 therefore judges that no rotation malfunction of the fan 4 occurs—the fan 4 is normal.

When detecting no occurrence of any rotation malfunction of the fan 4, the control circuit 131 preferably notifies a second power supply circuit 12 of a second control signal S2 representing Vo1 as an ordinary target voltage value as shown in "Vo" of FIG. 8. The second power supply circuit 12 adjusts a value of drive voltage Vo to the ordinary target voltage value Vo1, thereby causing the fan 4 to rotate at an ordinary speed of rotation.

When the speed of rotation of the fan 4 decreases as a result of the occurrence of a rotation malfunction of the fan 4 (at timing t21), the rotation detection signal S3 becomes a constant low-level. As a result, the smoothed signal S4 decreases. When the voltage of the smoothed signal S4 is smaller than or equal to the lower limit threshold Vt2 (at timing t22) and then the second predetermined time T2 elapses therefrom, the control circuit 131 judges that a rotation malfunction of the fan 4 occurs (at timing t23).

When detecting the occurrence of a rotation malfunction of the fan 4, the control circuit 131 preferably notifies the second power supply circuit 12 of a second control signal S2 representing Vo2 as a temporary target voltage value. The temporary target voltage value Vo2 is larger than the ordinary target voltage value Vo1, and therefore second electric power corresponding to the temporary target voltage value Vo2 is larger than second electric power corresponding to the ordinary target voltage value Vo1. The second power supply circuit 12 adjusts the value of the drive voltage Vo to the temporary target voltage value Vo2, thereby increasing electric power. Therefore, when a rotation malfunction of the fan 4 occurs, the second power supply circuit 12 increases the output power to increase the speed of rotation of the fan 4.

Here, it is assumed that the occurrence of a rotation malfunction of the fan 4 as a result of a decrease in the speed of rotation thereof causes an increase in each temperature of a first power supply circuit 11 and a lighting load 2. Embodiment 3 therefore increases the drive voltage Vo to increase the speed of rotation of the fan 4, thereby protecting the first power supply circuit 11 and the lighting load 2.

The control circuit 131 preferably notifies the first power supply circuit 11 of a first control signal S1 representing Io1 as an ordinary target current value both when detecting the occurrence of a rotation malfunction of the fan 4 and when detecting no occurrence thereof. The first power supply circuit 11 adjusts a value of a load current Io to the ordinary target current value Io1, thereby causing the lighting load 2 to go on at an ordinary light output.

Embodiment 3 thus causes the lighting load 2 to continue going on at the ordinary light output while protecting the first power supply circuit 11 and the lighting load 2, even when a rotation malfunction of the fan 4 occurs, and therefore user's convenience is secured.

Figure 9:
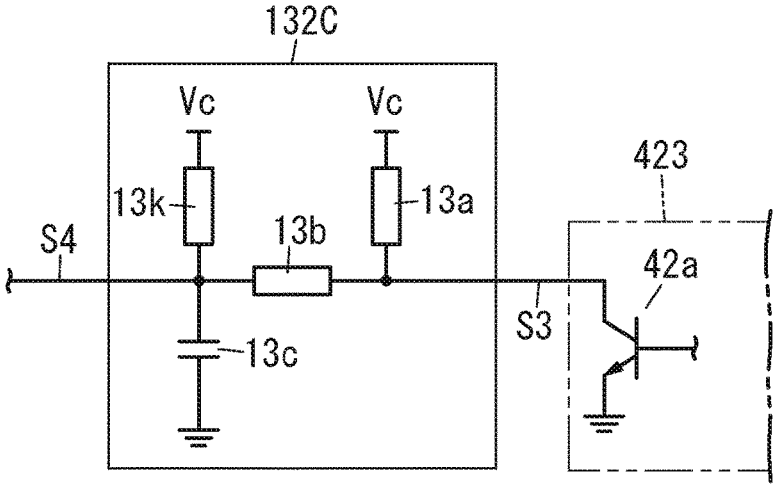
FIG. 9 is a circuit diagram showing a modified example of the smoothing circuit.

FIG. 9 shows a configuration of a smoothing circuit 132C in a modified example of Embodiment 3.

When a rotation detection signal S3 is a binary pulse signal, a smoothed signal S4 has a comparatively low voltage if the rotation detection signal S3 is a high-level for a short time. As a result, even if a fan 4 is normal, the smoothed signal S4 may be outside the range larger than a lower limit threshold Vt2 and smaller than an upper limit threshold Vt1.

Therefore, the smoothing circuit 132C includes a configuration below.

The smoothing circuit 132C further includes a resistor 13*k* in addition to a pull-up resistor 13*a*, a smoothing resistor 13*b* and a smoothing capacitor 13*c*. The resistor 13*k* has a first end that is electrically connected to a control power supply (e.g., supply source of control voltage Vc to output adjustment circuit 13), and a second end. The second end of the resistor 13*k* is electrically connected to a junction of the resistor 13*b* and the capacitor 13*c*.

When the rotation detection signal S3 is a low-level, the control voltage Vc is divided by the resistors 13*k* and 13*b* to be applied across the capacitor 13*c*. The voltage of the smoothed signal S4 is accordingly equal to the voltage across the capacitor 13*c*. That is, when the rotation detection signal S3 is a low-level, the voltage of the smoothed signal S4 is kept at a high value by voltage obtained by dividing the control voltage Vc by the resistors 13*k* and 13*b*. As a result, even if the rotation detection signal S3 is a high-level for a short time, the voltage of the smoothed signal S4 can be kept at a comparatively high value. Therefore, when the fan 4 is normal, the smoothed signal S4 is easily in the range larger than the lower limit threshold Vt2 and smaller than the upper limit threshold Vt1.

Figure 10:
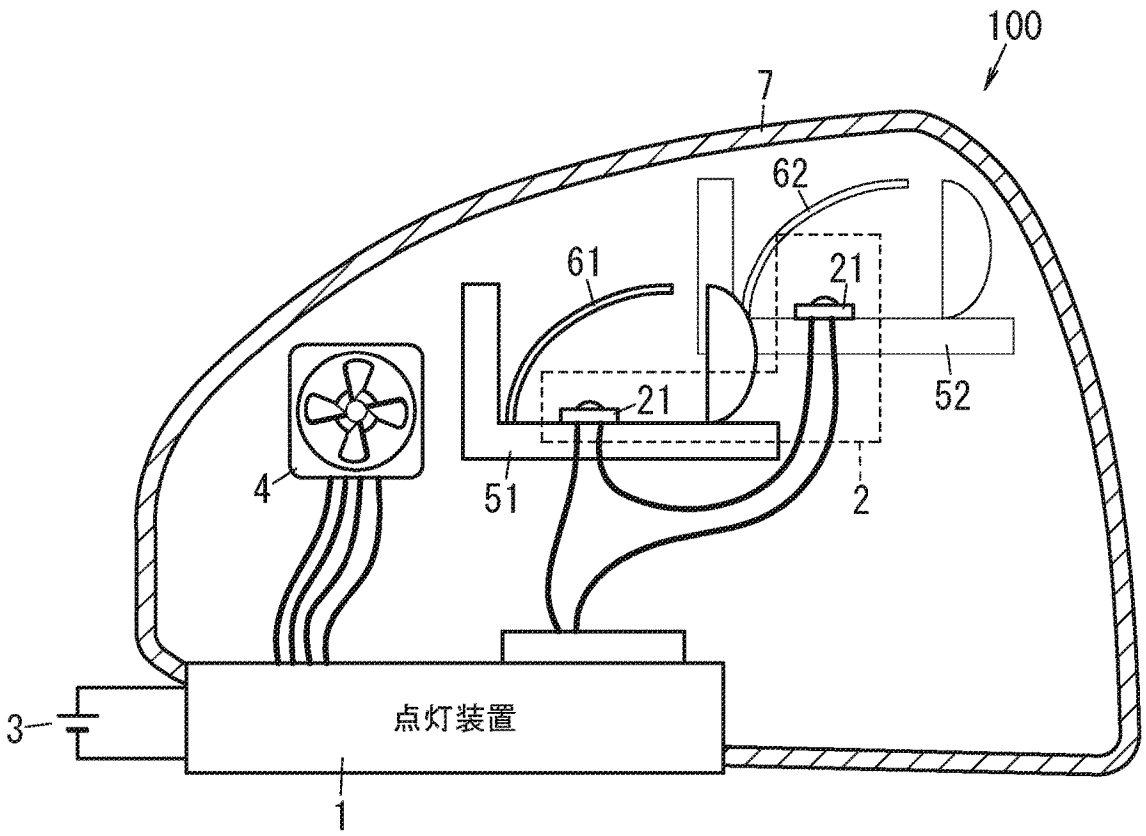
FIG. 10 is a sectional view showing a headlight device.

For example, a lamp device such as a vehicle headlight (headlamp) device is preferably equipped with a lighting device 1 according to each of the above embodiments. FIG. 10 shows a configuration of a headlight device 100.

The headlight device 100 preferably includes the lighting device 1, a lighting load 2, a fan 4, heat sinks (heat exchangers) 51 and 52, reflectors 61 and 62 and the headlight body 7. The lighting load 2 includes LEDs 21 distributed and mounted on the heat sinks 51 and 52. The reflectors 61 and 62 are respectively provided for the heat sinks 51 and 52 so as to control distribution of luminous intensity of the lighting load 2. The headlight body 7 houses the lighting load 2, the fan 4, the heat sinks 51 and 52, and the reflectors 61 and 62 with the lighting device 1 situated in a bottom of the headlight body 7. The lighting device 1 is supplied with electric power from an on-vehicle battery as a DC power supply 3 to be activated. The fan 4 is situated in the headlight body 7 to create a current of air toward the lighting load 2.

In the headlight device 100, the LEDs 21 on the heat sink 51 may function as a meeting beam (low beam) headlight, while the LEDs 21 on the heat sink 52 may function as a driving beam (high beam) headlight.

Figure 11:
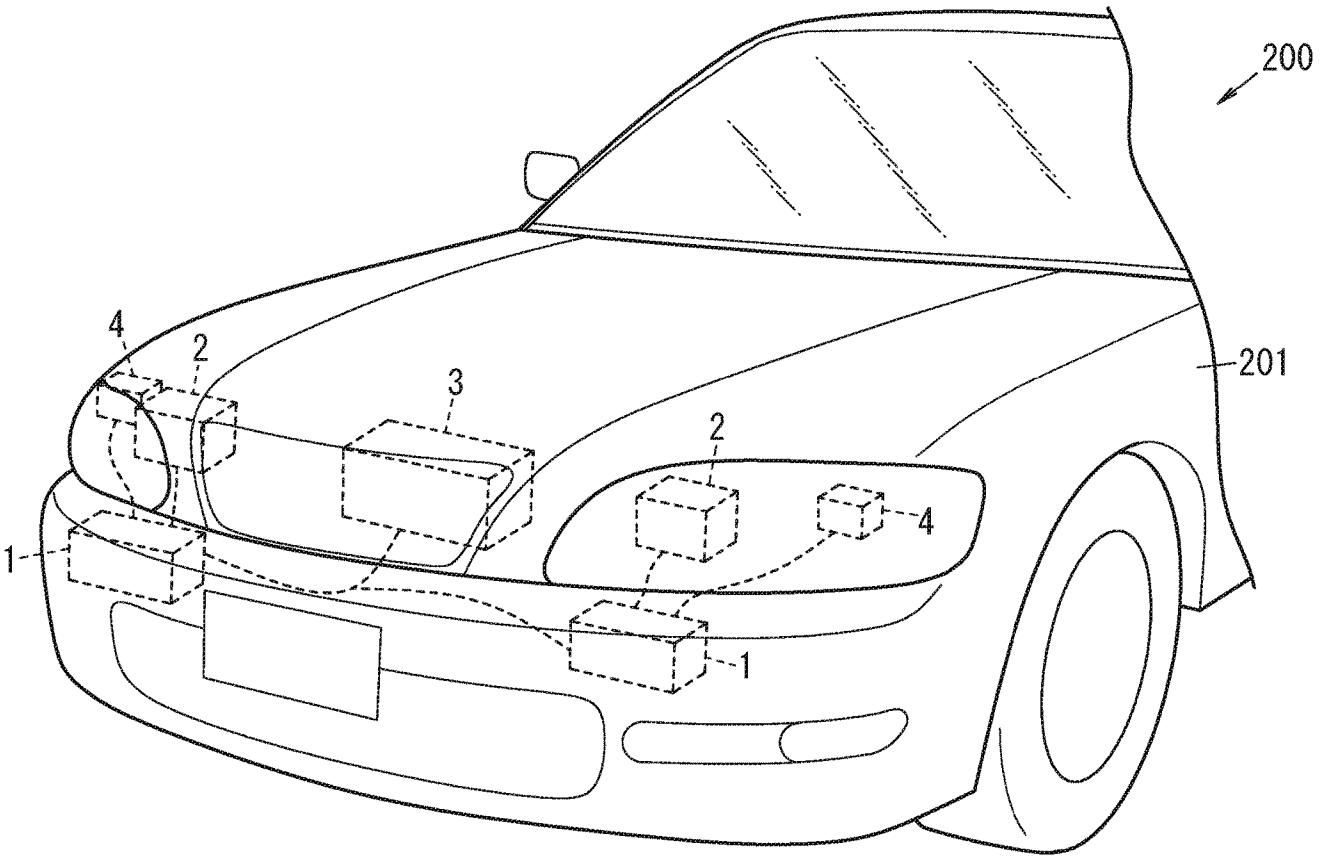
FIG. 11 is a perspective view showing part of a vehicle.

FIG. 11 is an outline perspective view of a vehicle 200 equipped with two headlight devices 100 described above on the left and right. The two headlight devices 100 are situated forward of a vehicle body 201 of the vehicle 200. Note that a lamp device equipped with the lighting device 1 is not limited to the headlight device 100, but may be a rear light device of the vehicle 200 or other lamp devices.

A light source of the lighting load 2 is not limited to the LEDs 21, but may be solid-state light-emitting devices such as organic electro luminescence (OEL) devices or semiconductor lasers (laser diodes (LDs)).

The embodiments described above exemplify specific resistance values of resistors, capacitance values of capacitors, voltage values of thresholds, current waveform, voltage waveform and signal waveform, but are not limited thereto.

A lighting device 1 according to a first aspect includes a first power supply circuit 11, a second power supply circuit 12 and an output adjustment circuit 13. The first power supply circuit 11 is configured to provide first electric power to the lighting load 2, thereby causing a lighting load 2 to be lit. The second power supply circuit 12 is configured to provide a fan 4 with second electric power to rotate the fan 4. The fan 4 is configured to cool at least one of the first power supply circuit 11 and the lighting load 2. The output adjustment circuit 13 is configured to control the first power supply circuit 11 and the second power supply circuit 12 to adjust the first electric power and the second electric power. The output adjustment circuit 13 includes a smoothing circuit 132 and a control circuit 131. The smoothing circuit 132 is configured to receive and smooth a rotation detection signal S3 to produce a smoothed signal S4. The rotation detection signal S3 is a binary signal in accordance with rotation of the fan 4. The control circuit 131 is configured to detect (the occurrence of) a rotation malfunction of the fan 4 when the smoothed signal S4 is larger than or equal to an upper limit threshold Vt1 (or Vt11) over first predetermined time T1 or when the smoothed signal S4 is smaller than or equal to a lower limit threshold Vt2 (Vt12) smaller than the upper limit threshold over second predetermined time T2. The control circuit 131 is also configured to vary at least one of the first electric power and the second electric power when detecting (the occurrence of) the rotation malfunction.

Thus, the lighting device 1 includes the smoothing circuit 132, thereby making it possible to detect a rotation malfunction of the fan 4 based on voltage of the smoothed signal S4. The control circuit 131 also detects a rotation malfunction of the fan 4 when the smoothed signal S4 is larger than or equal to the upper limit threshold Vt1 over the first predetermined time T1 or when the smoothed signal S4 is smaller than or equal to the lower limit threshold Vt2 over the second predetermined time T2. As a result, even if the control circuit 131 has no pulse measuring function, the lighting device 1 can detect a rotation malfunction of the fan 4 based on the binary rotation detection signal S3, and suppress the occurrence of a rotation malfunction of the fan 4 detected in error.

In the first aspect, as a lighting device 1 according to a second aspect, the control circuit 131 is preferably configured to detect (the occurrence of) the rotation malfunction when the number of times that the smoothed signal S4 is larger than or equal to the upper limit threshold Vt1 (or Vt11) over the first predetermined time T1 is larger than or equal to a first threshold. The control circuit 131 is also preferably configured to detect (the occurrence of) the rotation malfunction when the number of times that the smoothed signal S4 is smaller than or equal to the lower limit threshold Vt2 (or Vt12) over the second predetermined time T2 is larger than or equal to a second threshold.

The lighting device 1 according to the second aspect can suppress the occurrence of a rotation malfunction of the fan 4 detected in error.

In a first or second aspect, as a lighting device 1 according to a third aspect, the control circuit 131 is preferably configured to cut off at least one of the first electric power and the second electric power when detecting (the occurrence of) the rotation malfunction.

When a rotation malfunction of the fan 4 occurs, the lighting device 1 according to the third aspect stops the supply of the first electric power, thereby making it possible to decrease quantity of heat to be dissipated away from each of the first power supply circuit 11 and the lighting load 2. The lighting device 1 can therefore suppress the occurrence of a malfunction caused by respective heat generated from the first power supply circuit 11 and the lighting load 2. In addition, when a rotation malfunction of the fan 4 occurs, the lighting device 1 stops the supply of the second electric power to stop the fan 4, thereby making it possible to delay the progress of degradation or malfunction of the fan 4.

In a first or second aspect, as a lighting device 1 according to a fourth aspect, the control circuit 131 is preferably configured to more decrease at least one of the first electric power and the second electric power when detecting (the occurrence of) the rotation malfunction than that when detecting no rotation malfunction (no occurrence of any rotation malfunction).

In a first or second aspect, as a lighting device 1 according to a fifth aspect, the control circuit 131 is preferably configured to more increase the second electric power when detecting (the occurrence of) the rotation malfunction than that when detecting no rotation malfunction (no occurrence of any rotation malfunction).

In any of the first to fifth aspects, as a lighting device 1 according to a sixth aspect, the control circuit 131 is preferably configured to, when detecting (the occurrence of) the rotation malfunction, vary at least one of the first electric power and the second electric power after detection waiting time W1 (predetermined time) from the time when the fan (4) starts rotating elapses.

The lighting device 1 according to the sixth aspect can suppress the occurrence of a rotation malfunction of the fan 4 detected in error during transient time after the fan 4 is activated.

In any of the first to sixth aspects, as a lighting device 1 according to a seventh aspect, the first predetermined time T1 preferably is set based on a time constant of the smoothing circuit 132 and the upper limit threshold Vt1 (or Vt11). The second predetermined time T2 preferably is set based on the time constant of the smoothing circuit 132 and the lower limit threshold Vt2 (or Vt12).

The lighting device 1 according to the seventh aspect can suppress the occurrence of a rotation malfunction of the fan 4 detected in error.

In any of the first to seventh aspects, as a lighting device 1 according to an eighth aspect, the smoothing circuit 132 is preferably a low pass filter 13*d* having a resistor 13*b* and a capacitor 13*c*.

The lighting device 1 according to the eighth aspect enables the smoothing circuit 132 to have a simple configuration.

In any of the first to seventh aspects, as a lighting device 1 according to a ninth aspect, the smoothing circuit 132 is preferably a low pass filter 13*i* having an operational amplifier 13*e*, two resistors 13*f* and 13*g*, and a capacitor 13*h*.

The lighting device 1 according to the ninth aspect can adjust the voltage of the smoothed signal S4 to a desired value by appropriately setting a gain of the low pass filter 13*i*.

In an eighth or ninth aspect, as a lighting device 1 according to a tenth aspect, a low pass filter 13*d* or 13*i* preferably has a cut-off frequency that is set based on a predetermined frequency range of the rotation detection signal S3.

The lighting device 1 according to the tenth aspect can suppress unsuccessful detection of the occurrence of a rotation malfunction of the fan 4 and the occurrence of a rotation malfunction of the fan 4 detected in error.

In any of the first to tenth aspects, as a lighting device 1 according to an eleventh aspect, the rotation detection signal S3 is preferably a pulse signal synchronized with rotation of the fan 4.

The lighting device 1 according to the eleventh aspect can detect the occurrence of a rotation malfunction of the fan 4 based on the rotation detection signal S3 even if the control circuit 131 has no pulse measuring function.

In any of the first to tenth aspects, as a lighting device 1 according to a twelve aspect, the rotation detection signal S3 has one value of the binary signal when no rotation malfunction (no occurrence of any rotation malfunction) of the fan 4 is detected, and another value of the binary signal when (the occurrence of) a rotation malfunction of the fan 4 is detected.

The lighting device 1 according to the twelve aspect can detect the occurrence of a rotation malfunction of the fan 4 based on the rotation detection signal S3.

In any of the first to twelve aspects, as a lighting device 1 according to a thirteenth aspect, the control circuit 131 is configured to vary a load current Io to be supplied to the lighting load 2 when varying the first electric power, and vary drive voltage Vo to be applied to the fan 4 when varying the second electric power.

The lighting device 1 according to the thirteenth aspect can light, dim and extinguish the lighting load 2, and adjust the speed of rotation of the fan 4.

A headlight device 100 according to an aspect includes a lighting device 1 of any one of the first to thirteenth aspects, the lighting load 2, the fan 4 that is configured to output the rotation detection signal S3, and a headlight body 7 to which the lighting device 1 and the fan 4 are attached.

Even if the control circuit 131 has no pulse measuring function, the headlight device 100 can detect the occurrence of a rotation malfunction of the fan 4 based on the rotation detection signal S3, and suppress the occurrence of a rotation malfunction of the fan 4 detected in error.

A vehicle 200 according to an aspect includes the headlight device 100 and a vehicle body 201 equipped with the headlight device 100.

Even if the control circuit 131 has no pulse measuring function, the vehicle 200 can detect the occurrence of a rotation malfunction of the fan 4 based on the binary rotation detection signal S3, and suppress the occurrence of a rotation malfunction of the fan 4 detected in error.

In each embodiment stated above, an upper limit threshold Vt1, Vt11 and a lower limit threshold Vt2, Vt12 are not included in a permissible range with respect to a change in a smoothed signal S4 when no rotation malfunction of a fan 4 occurs, but an upper limiting value and a lower limiting value of the permissible range may be employed instead of the upper limit threshold and the lower limit threshold, respectively. Each embodiment stated above is also a lighting device 1 configured to be electrically connected to a lighting load 2, but may be a power supply 1 configured to be electrically connected to a load 2 such as an electric motor.

That is, the power supply 1 includes a pair of first terminals T11 and T12, a pair of second terminals T21 and T22, a first power supply circuit 11, a second power supply circuit 12, a detector 421 and 422, an output circuit 423, a smoothing circuit 132 (132A, 132B or 132C), and a control circuit 131. The pair of first terminals T11 and T12 is provided for the supply of electric power to a load 2. The pair of second terminals T21 and T22 is provided for the supply of electric power to a fan 4. The first power supply circuit 11 is configured to output electric power to a side of the pair of first terminals T11 and T12. The second power supply circuit 12 is configured to output electric power to a side of the pair of second terminals T21 and T22. The detector 421 and 422 is configured to produce a rotation signal S30 with a period. Here, the period varies according to a speed of rotation (number of rotations per unit time) of the fan 4. The output circuit 423 is configured to receive the rotation signal S30 to output a rotation detection signal S3. The smoothing circuit 132 is configured to smooth the rotation detection signal S3 to produce a smoothed signal S4. Here, the smoothed signal S4 is a unipolar signal. The control circuit 131 is configured to cause the first power supply circuit 11 to output first electric power for driving the load 2, and cause the second power supply circuit 12 to output second electric power for driving the fan 4. The first electric power is, for example electric power for driving the load 2 at rated output thereof, and the second electric power is, for example electric power for driving the fan 4 at rated output thereof. The control circuit 131 is also configured to compare a value of the smoothed signal S4 with a limiting value Vt1, Vt11, Vt2, Vt12. Here, the limiting value is at least one limiting value Vt1, Vt11, Vt2, Vt12 of a permissible range predetermined with respect to a change in the smoothed signal S4. The control circuit 131 is further configured to cause the first power supply circuit 11 to decrease the first electric power to temporary electric power smaller than the first electric power when the value of the smoothed signal S4 crosses the limiting value to be out of the permissible range for predetermined time T1, T2. Here, as stated above, the at least one limiting value is employed instead of an upper limit threshold Vt1 or Vt11, or a lower limit threshold Vt2 or Vt12.

In a preferable example of the power supply 1, the detector 421 and 422 is configured to produce the rotation signal S30 that is a pulsating signal with the period varying at a constant duty cycle (duty ratio) according to a change in the speed of rotation of the fan 4. However, the detector of the power supply 1 is not limited to this. In an example, the detector may include a light emitting device configured to continuously emit light so that the light passes through spaces among blades 41 having light blocking effect of the fan 4, and a light receiving device configured to receive the light, and be configured to produce a pulse train signal from the light receiving device as the rotation signal S30.

In a first example of the power supply 1 as a modified example of the preferable example, the output circuit 423 is configured to receive the rotation signal S30 to output, as the rotation detection signal S3, a pulse train signal with a period varying at a constant duty cycle according to the change in the speed of rotation of the fan 4 (see "S3" of FIG. 3).

In a second example of the power supply 1 as another modified example of the preferable example, the output circuit 423 is configured to receive the rotation signal S30 to output the rotation detection signal S3 by outputting a pulse train signal with a constant duty cycle and a constant period if a period of the rotation signal S30 is in a predetermined period range and otherwise outputting a high level signal (see "S3" of FIG. 6). Herein, the predetermined period range is a permissible range predetermined with respect to the period of the rotation signal S30.

In a third example of the power supply 1 as still another modified example of the preferable example, the output circuit 423 is configured to receive the rotation signal S30 to output the rotation detection signal S3 by outputting a high level signal if a period of the rotation signal S30 is in the predetermined period range and otherwise outputting a low level signal (see "S3" of FIG. 8).

In the first example of the power supply 1, the smoothing circuit 132 includes a low pass filter 13*d* that is configured to be supplied with the rotation detection signal S3 with predetermined control voltage Vc supplied thereto (see FIG. 2). For example, the low pass filter 13*d* includes a resistor 13*b* electrically connected between the output circuit 423 and the control circuit 131, and a capacitor 13*c* electrically connected between ground (control ground) and a junction of the resistor 13*b* and the control circuit 131.

In the second example of the power supply 1, the smoothing circuit 132 includes a low pass filter 13*i* that is configured to be supplied with the rotation detection signal S3 with predetermined control voltage Vc supplied thereto (see FIG. 5). For example, the low pass filter 13*i* includes a resistor 13*f*, an op-amp 13*e*, and a parallel circuit of a resistor 13*g* and a capacitor 13*h*. The op-amp 13*e* has an inverted input terminal electrically connected to the output circuit 423 via the resistor 13*f*, a non-inverted input terminal electrically connected to ground (control ground), and an output terminal electrically connected to the control circuit 131. The parallel circuit is electrically connected between the non-inverted input terminal and the output terminal.

In the third example of the power supply 1, the smoothing circuit 132 includes a low pass filter 13*d* like the first example, and is configured to apply divided voltage obtained from predetermined control voltage Vc to an output end of the low pass filter 13*d* (see FIG. 7). For example, the smoothing circuit 132 further includes a resistor 13*j* electrically connected in parallel with a capacitor 13*c* of the low pass filter 13*d*.

Another preferable example of the power supply 1 include the permissible range as a first permissible range, and further includes a second permissible range. The control circuit 131 is configured to cause the second power supply circuit 12 to increase the second electric power to correction power larger than the second electric power when the value of the smoothed signal S4 crosses at least one limiting value of the second permissible range to be out of the second permissible range for predetermined time (see "Vo" of FIG. 8). Here, the second permissible range is set based on a variation range of a speed of rotation of the fan 4 due to aged deterioration exclusive of failure of the fan 4.

In other words, when the value of the smoothed signal S4 crosses at least one limiting value of the first permissible range (or third permissible range) to be out of the first permissible range (or third permissible range) for predetermined time, the fan 4 can be regarded as failure. Herein, the second permissible range is narrower than the first permissible range and included in the first permissible range, and the third permissible range is wider than the first permissible range and includes the first permissible range. In this case, it is desirable that the control circuit 131 be configured to cause the second power supply circuit 12 to decrease the correction power to the second electric power or temporary electric power (including zero) smaller than the second electric power.

In the power supply 1, the fan 4 may be provided with the detector 421 and 422 and the output circuit 423.

Note that the abovementioned detector and the output circuit 423 are provided for the fan 4 as an external device as shown in FIG. 1 and therefore not indispensable to the power supply 1, but the power supply 1 may be provided with each of the detector and the output circuit 423 as an option.

In an example, the power supply 1 may include a pair of first terminals T11 and T12, a pair of second terminals T21 and T22, a first power supply circuit 11, a second power supply circuit 12, a smoothing circuit 132 (132A, 132B or 132C), and a control circuit 131. In this example, a fan 4 as an external device is provided with, as non-components of the power supply 1, a detector configured to produce a rotation signal S30 with a period, and an output circuit 423 configured to receive the rotation signal S30 to output a rotation detection signal S3. Here, the period varies according to a speed of rotation of the fan 4.

In another example, the power supply 1 may include a pair of first terminals T11 and T12, a pair of second terminals T21 and T22, a first power supply circuit 11, a second power supply circuit 12, an output circuit 423, a smoothing circuit 132 (132A, 132B or 132C), and a control circuit 131. In this example, a fan 4 as an external device is provided with, as a non-component of the power supply 1, a detector configured to produce a rotation signal S30 with a period. Here, the period varies according to a speed of rotation of the fan 4.

In still another example, the detector may be an anemometer configured to measure the speed of wind from the fan 4, or an air flow meter configured to measure air flow from the fan 4. A detector in this case is configured to produce a rotation signal, a level of which varies according to a change in the speed of rotation of the fan 4. In addition, an output circuit in this case is configured to receive the rotation signal to output a rotation detection signal by outputting a pulse train signal with a constant duty cycle and a constant period if a level of the rotation signal is in a predetermined level range and otherwise outputting a high level signal.

In short, a detector in each embodiment is configured to produce a rotation signal S30 having a feature that varies according to the speed of rotation of the fan 4. Examples of the feature include a period, a frequency, and levels such as a voltage value, a current value, a wind speed value and an air flow value.

Note that in the embodiments and examples described above, the detector and the output circuit 423 are provided, but only the output circuit 423 may be provided for, e.g., the fan 4. In this case, the output circuit 423 is configured to output a rotation detection signal S3 that varies according to a speed of rotation of the fan (4).

The control circuit 131 may be a central processing unit (CPU) such as microprocessor, a microcontroller, an application-specific integrated circuit (ASIC), or a field-programmable gate array (FPGA). In another example, the control circuit 131 may include multiple CPU cores and may include one or more memories.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

REFERENCE SIGNS LIST

1 Lighting device
11 First power supply circuit
12 Second power supply circuit
13 Output adjustment circuit
131 Control circuit
132, 132A, 132B, 132C Smoothing circuit
13*b*, 13*f*, 13*g* Resistor
13*c*, 13*h* Capacitor
13*d*, 13*i* Low pass filter
13*e* Op-amp
2 Lighting load
21 LED
3 DC power supply
4 Fan
7 Headlight body
100 Headlight device
200 Vehicle
201 Vehicle body
S30 Rotation signal
S3 Rotation detection signal
S4 Smoothed signal
T1 First predetermined time
T2 Second predetermined time
Io Load current (Current)
Vo Drive voltage (Voltage)
Vt1, Vt11 Upper limit threshold
Vt2, Vt12 Lower limit threshold
W1 Detection waiting time (Predetermined time)

The invention claimed is:

1. A lighting device, comprising:

a first power supply circuit that is configured to provide first electric power to a lighting load to cause the lighting load to be lit, a second power supply circuit that is configured to provide a fan with second electric power to rotate the fan, the fan being configured to cool at least one of the first power supply circuit and the lighting load, an output adjustment circuit that is configured to control the first power supply circuit and the second power supply circuit to adjust the first electric power and the second electric power, the output adjustment circuit comprising a smoothing circuit that is configured to receive and smooth a rotation detection signal to produce a smoothed signal, the rotation detection signal being a binary signal in accordance with rotation of the fan, and a control circuit that is configured to detect a rotation malfunction of the fan to vary at least one of the first electric power and the second electric power when the smoothed signal is larger than or equal to an upper limit threshold over first predetermined time or when the smoothed signal is smaller than or equal to a lower limit threshold smaller than the upper limit threshold over second predetermined time.

2. The lighting device of claim 1, wherein the control circuit is configured to detect the rotation malfunction when a number of times that the smoothed signal is larger than or equal to the upper limit threshold over the first predetermined time is larger than or equal to a first threshold, or when a number of times that the smoothed signal is smaller than or equal to the lower limit threshold over the second predetermined time is larger than or equal to a second threshold.

3. The lighting device of claim 1, wherein the control circuit is configured to cut off at least one of the first electric power and the second electric power when detecting the rotation malfunction.

4. The lighting device of claim 1, wherein the control circuit is configured to more decrease at least one of the first electric power and the second electric power when detecting the rotation malfunction than that when detecting no rotation malfunction.

5. The lighting device of claim 1, wherein the control circuit is configured to more increase the second electric power when detecting the rotation malfunction than that when detecting no rotation malfunction.

6. The lighting device of claim 1, wherein the control circuit is configured to, when detecting the rotation malfunction, vary at least one of the first electric power and the second electric power after predetermined time from time when the fan starts rotating elapses.

7. The lighting device of claim 1, wherein the first predetermined time is set based on a time constant of the smoothing circuit and the upper limit threshold, and the second predetermined time is set based on the time constant of the smoothing circuit and the lower limit threshold.

8. The lighting device of claim 1, wherein the smoothing circuit is a low pass filter having a resistor and a capacitor.

9. The lighting device of claim 1, wherein the smoothing circuit is a low pass filter having an operational amplifier, two resistors and a capacitor.

10. The lighting device of claim 8, wherein the low pass filter has a cut-off frequency that is set based on a predetermined frequency range of the rotation detection signal.

11. The lighting device of claim 9, wherein the low pass filter has a cut-off frequency that is set based on a predetermined frequency range of the rotation detection signal.

12. The lighting device of claim 1, wherein the rotation detection signal is a pulse signal synchronized with rotation of the fan.

13. The lighting device of claim 1, wherein the rotation detection signal has one value of the binary signal when no rotation malfunction of the fan is detected, and another value of the binary signal when the rotation malfunction of the fan is detected.

14. The lighting device of claim 1, wherein the control circuit is configured to vary an electric current to be supplied to the lighting load when varying the first electric power, and vary voltage to be applied to the fan when varying the second electric power.

15. A headlight device, comprising a lighting device of claim 1, the lighting load, the fan that is configured to output the rotation detection signal, and a headlight body to which the lighting device and the fan are attached.

16. A vehicle, comprising the headlight device of claim 15, and a vehicle body that is equipped with the headlight device.

17. A power supply, comprising a pair of first terminals for supply of electric power to a load, a pair of second terminals for supply of electric power to a fan, the fan comprising an output circuit configured to output a rotation detection signal that varies according to a speed of rotation of the fan, a first power supply circuit that is configured to output electric power to a side of the pair of first terminals, a second power supply circuit that is configured to output electric power to a side of the pair of second terminals, a smoothing circuit that is configured to smooth the rotation detection signal from the output circuit to produce a smoothed signal, the smoothed signal being a unipolar signal, and a control circuit that is configured to cause the first power supply circuit to output first electric power for driving the load, and cause the second power supply circuit to output second electric power for driving the fan, the control circuit being also configured to compare a value of the smoothed signal with a limiting value, the limiting value being at least one limiting value of a permissible range predetermined with respect to a change in the smoothed signal, and the control circuit being further configured to cause the first power supply circuit to decrease the first electric power to temporary electric power smaller than the first electric power when the value of the smoothed signal crosses the limiting value to be out of the permissible range for predetermined time.

* * * * *